US006209839B1

(12) United States Patent
O'Malley

(10) Patent No.: US 6,209,839 B1
(45) Date of Patent: Apr. 3, 2001

(54) PLASTIC STACKING SUPPORT FOR ROLL STOCK

(76) Inventor: Joseph O'Malley, 251 W. Taylor Rd, Selah, WA (US) 98942

( * ) Notice: Subject to any disclaimer, the term of this patent is extended or adjusted under 35 U.S.C. 154(b) by 0 days.

(21) Appl. No.: 09/330,536

(22) Filed: Jun. 11, 1999

(51) Int. Cl.[7] ..... B65D 19/00
(52) U.S. Cl. ..... 248/346.02; 248/68.1
(58) Field of Search ..... 248/346.01, 346.02, 248/681; 211/59.4; 206/391, 597, 419

(56) References Cited

U.S. PATENT DOCUMENTS

| | | | | |
|---|---|---|---|---|
| D. 345,845 | | 4/1994 | Strzegowski, Jr. | D34/38 |
| D. 381,180 | | 7/1997 | Scheuneman et al. | D34/38 |
| D. 384,481 | | 9/1997 | Sheckells | D34/38 |
| D. 385,080 | | 10/1997 | Schueneman et al. | D34/38 |
| D. 400,441 | | 11/1998 | Warren | D9/456 |
| D. 403,961 | | 1/1999 | Warren | D9/456 |
| 2,766,660 | * | 10/1956 | Laddon et al. | 89/1.51 |
| 3,837,560 | | 9/1974 | Kochuris et al. | 229/15 |
| 4,195,732 | * | 4/1980 | Bell | 206/391 |
| 4,240,557 | | 12/1980 | Dickens | 211/153 |
| 4,378,923 | * | 4/1983 | Takei | 248/68.1 |
| 4,435,463 | | 3/1984 | Roellchen | 428/158 |
| 4,610,362 | | 9/1986 | Remp et al. | 211/59.4 |
| 4,705,170 | | 11/1987 | Creaden | 206/419 |
| 4,792,045 | | 12/1988 | Creaden | 206/419 |
| 4,832,196 | * | 5/1989 | Butler | 206/391 |
| 4,901,870 | | 2/1990 | Wright et al. | 211/59.4 |
| 4,936,453 | | 6/1990 | Knitter | 206/419 |
| 5,080,314 | * | 1/1992 | Moyer et al. | 206/391 X |
| 5,100,076 | | 3/1992 | Cobane et al. | 242/71.8 |
| 5,123,547 | * | 6/1992 | Kuch | 211/59.4 |
| 5,161,703 | | 11/1992 | Patton | 211/294 |
| 5,381,898 | | 1/1995 | Jones | 206/391 |
| 5,415,286 | | 5/1995 | Marchek et al. | 206/330 |
| 5,421,537 | | 6/1995 | Cobane et al. | 242/614 |
| 5,433,322 | * | 7/1995 | Williams | 206/443 |
| 5,499,716 | | 3/1996 | Gardner | 206/553 |
| 5,649,632 | | 7/1997 | Terashima et al. | 211/59.4 |
| 5,755,541 | | 5/1998 | Suarez | 410/36 |
| 5,829,592 | | 11/1998 | Henry, Jr. et al. | 206/416 |
| 5,873,460 | | 2/1999 | Reinhardt | 206/321 |
| 5,899,331 | | 5/1999 | Warren, Jr. | 206/443 |
| 5,934,467 | | 8/1999 | Gilfert et al. | 206/391 |
| 5,960,954 | | 10/1999 | Seybold | 206/389 |

OTHER PUBLICATIONS

"Stakker Roll Packaging System" advertising flyer, Aug. 1, 1995, Henry Molded Products Inc., 71 North 16th Street, Lebanon, PA 17046.

* cited by examiner

*Primary Examiner*—Ramon O. Ramirez
(74) *Attorney, Agent, or Firm*—Stratton Ballew PLLC

(57) ABSTRACT

A support for receiving and supporting stacked tiers of cylindrical roll stock is provided. The support can be either located on the base tier of the rolls, folded between tiers, or placed on the top tier, all to provide a rectangular stacked arrangement of the roll stock that is especially suited for storage or transport. The roll support includes a support body that is preferably formed from a resinous plastic, polymeric material, such as PET that includes a plurality of curved cradles and each curved cradle is sized for receiving a roll of cylindrical stock. A multiple of the support bodies combine to support a multiple of the rolls of cylindrical stock in a tiered array. Each support body can substantially support the weight of each roll of cylindrical stock received within its curved cradles. The weight of the support body is less than the supported weight of the roll of cylindrical stock. Additionally, the support can nest together in storage, with a minimum of increase in the nested stack height, when roll supports are added to the stack.

17 Claims, 3 Drawing Sheets

PLASTIC STACKING SUPPORT FOR ROLL STOCK

TECHNICAL FIELD

The invention relates to a stacking support, and more particularly to a stacking support for heavy roll stock, wherein the stacking support is fabricated from a plastic material.

BACKGROUND OF THE INVENTION

"Roll stock" is a common term used to describe cylindrical rolls of thin materials, such as plastic films, roofing sheets, light gauge metal, and paper products. These cylindrical rolls are typically shipped and stored on pallets in tiers of the rolls, all horizontally oriented. To stabilize and support these rolls in their tiers, stacking supports are typically employed. Several U.S. patents show stacking supports for receiving stacked rolls of materials.

One such disclosure is found in U.S. Pat. No. 4,195,732 to Bell, which teaches a support and spacing member for roll stock formed from expanded polystyrene foam. Similarly, U.S. Pat. No. 4,832,196 to Butler shows a roll support member that like Bell '732 is formed of expanded polystyrene foam. However, there are problems associated with polystyrene foam when it is used for roll stock supports. Expanded polystyrene is brittle and has a minimum of structural flexibility. Additionally, polystyrene foam cannot nest together for the compact storage of unused supports.

In an apparent attempt to improve upon the inadequacies of polystyrene foam, U.S. Pat. No. 5,080,314 to Moyer teaches a roll support formed of recyclable papier-mache. In many circumstances, papier-mache is inadequate for roll stock supports. Papier-mache disintegrates when it is moist. Therefore, papier-mache cannot be used in humid environments and always must be protected from weather. This protection is especially difficult during transport unless the roll stock with its papier-mache supports are shipped within a container or trailer. A stronger, yet still recyclable material is needed that can form roll supports.

Granted, the Moyer '314 papier-mache roll support has better nesting capabilities than the polystyrene foam roll supports. However, Moyer '314 still fails to adequately nest together for saving space when stacking the supports in storage. Importantly, papier-mache must be fabricated with substantial thickness to support heavy roll stock. Therefore, papier-mache supports cannot stackably nest for compact storage of the unused roll supports. A roll support is needed for heavy roll stock that can nest together in storage, with a minimum increase in the nested stack height when roll supports are added to the stack.

SUMMARY OF INVENTION

The invention provides a support for receiving and supporting stacked tiers of cylindrical roll stock. The support can be either located on a base tier of the rolls, folded between tiers, or placed on a top tier, all to provide a rectangular stacked arrangement, or array of the roll stock that is especially suited for storage or transport. The roll supports nest within each other, substantially reducing the storage space required for unused supports. The roll supports are most preferably formed from a thermoformed and recyclable plastic, such as PET.

The support receives and supports horizontally stacked tiers of cylindrical roll stock. The support includes a support body formed from a plastic material. The support body has a first surface and a second surface. The first surface includes a plurality of curved cradles and each curved cradle is sized for receiving a roll of cylindrical stock.

The support body function to stabilize the tiered array of the cylindrical stock. A multiple of the support bodies combine to support a multiple of the rolls of cylindrical stock. Firstly, the rolls of cylindrical stock are supported by the support bodies to form a bottom tier of supported roll stock. The bottom tier of the supported roll stock then supports a minimum of two additional tiers of the cylindrical roll stock. Each of the additional tiers of the cylindrical roll stock is also supported by additional support bodies.

Each support body can substantially support the weight of each roll of cylindrical stock received within its curved cradles. The support body has a weight and the roll of cylindrical stock has a total weight and a supported weight. The weight of the support body is much less than the supported weight of the roll of cylindrical stock. Additionally, the support body has a height and the support body can stackably nest onto another support body while only minimally increasing the height of the support body.

According to one aspect of the invention, the roll support is strong enough to support heavy roll stock material, yet is still recyclable.

According to another aspect of the invention, the roll support can nest together in storage, with a minimal increase in the nested stack height, when roll supports are added to the stack.

The invention will be better understood by reference to the following detailed description taken in conjunction with the accompanying drawings.

DETAILED DESCRIPTION OF SPECIFIC EMBODIMENTS

Figure 1:
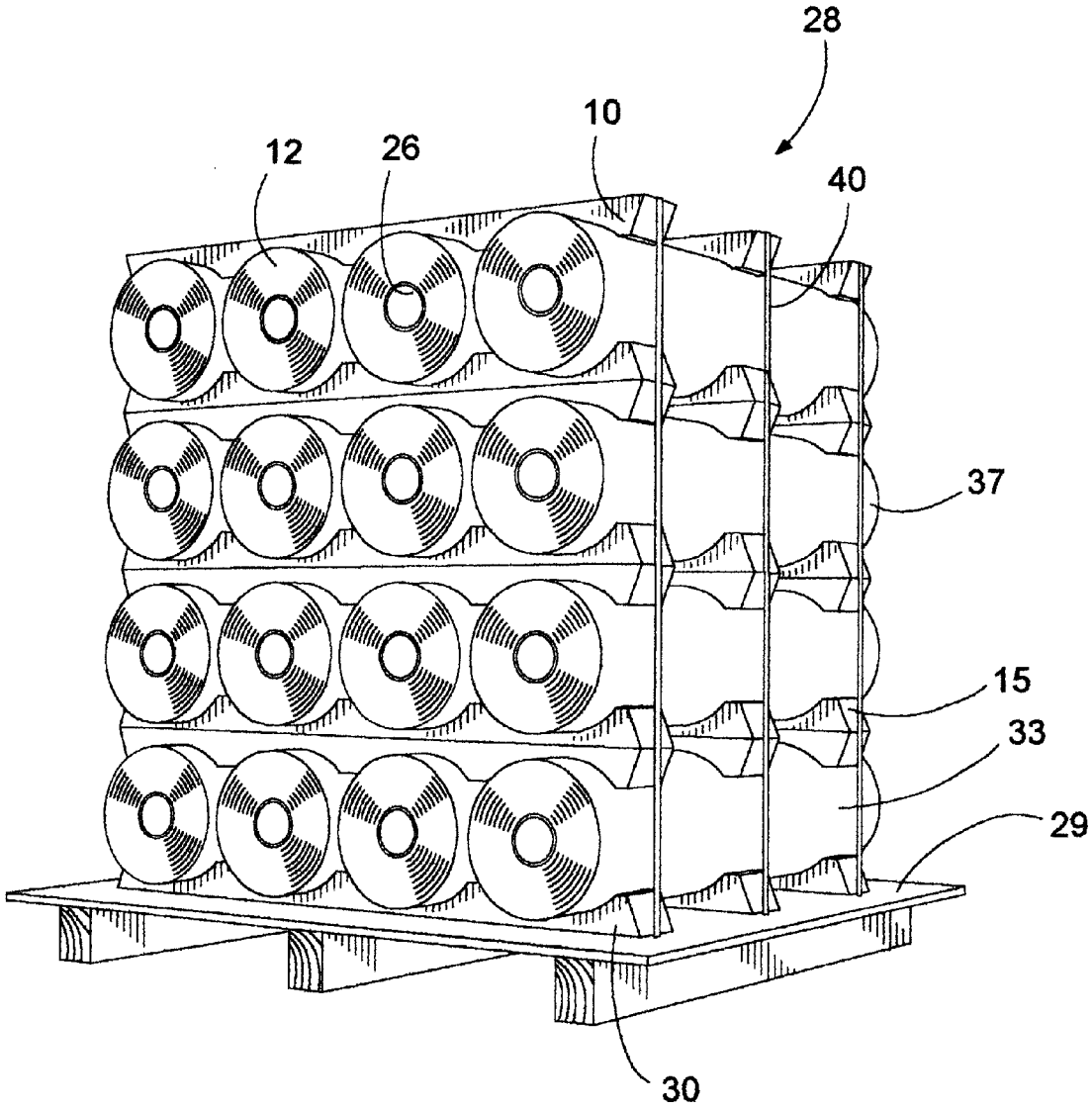
FIG. 1 is a perspective view of a plurality of roll support, according to an embodiment of this invention.
Figure 4:
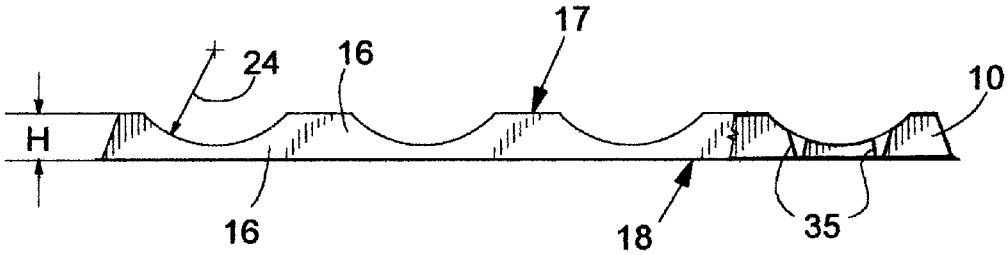
FIG. 4 is a partially sectioned side view of a roll support, according to an embodiment of this invention.
Figure 5:
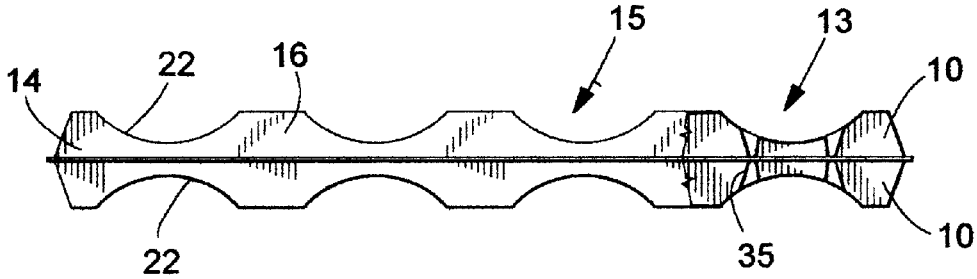
FIG. 5 is a partially sectioned side view of a pair of roll supports, according to an embodiment of this invention.
Figure 6:
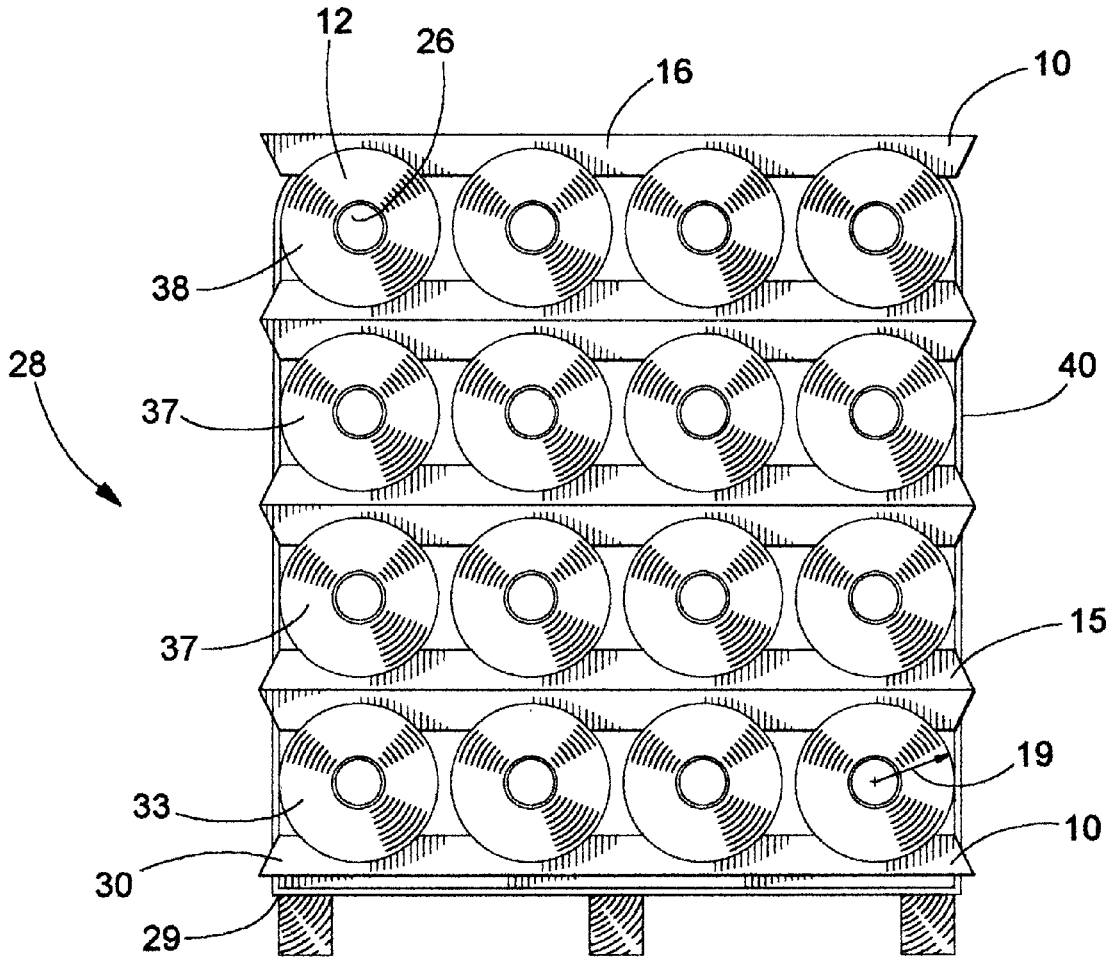
FIG. 6 is an end view of a plurality of roll supports, according to an embodiment of this invention.

The present invention is shown in FIGS. 1 through 6 and includes a roll support 10 manufactured from a plastic material. As shown in FIG. 1 and 6, a multiple of the roll supports combine with elements of a roll stock 12, to support the roll stock for storage and shipping.

Resinous supports are disclosed in U.S. Pat. No. 4,936,453 to Knitter, which shows a synthetic resin support for flourescent tubes. Knitter '453 narrowly specifies that the tube supports only for use with light weight tubes. Knitter '453 fails to broaden the use of these resin supports to any application other than fragile and light weight flourescent tubes. In practice, the resin supports of Knitter '453 cannot support heavier articles such as roll stock 12.

Knitter '453 totally fails to teach beyond uses with flourescent tubes. This is because Knitter '453 supports would collapse and be crushed if employed to support heavier items such as roll stock. The specific configurational features of Knitter '453 are specifically designed to cushion the tubes from destructive impacts, not for the support of weight. Additionally, Knitter '453 specifically teaches that the resin supports, preferably made form polyvinyl chloride (PVC) can nest in storage into stacks separated by at least ⅛th of an inch. Importantly, the stacking features of Knitter '453 are to facilitate machine automation, instead for providing for the compact storage of unused trays.

The roll support 10 of the present invention is manufactured from a resinous plastic, polymeric material. Preferably, the resinous plastic utilized for the roll support is a high density polymer. The resinous plastic polymer material is thermoformed to the preferred shape shown in FIGS. 1 through 4. Unlike the PVC material utilized by Knitter '453 that is easily deformable, especially when a minimum of material thickness is employed, the present invention most preferably employs polyethylene terephthalate, commonly called "PET." Instead of providing a cushioning and flexible support, as desired when protecting a fragile article, the roll support of the present invention must be strong and resistant to deformation. To support heavier items, PET resin forms a high strength product through the ability of the individual polymer chains to "cross-orient" on a molecular scale.

The roll support 10 of the present invention is preferably fabricated from recycled plastic, polymeric materials. Utilizing recycled plastic material is a great advantage over cellulose materials that are considered more difficult to manufacture from recycled waste products. Cellulose materials must be strictly segregated, homogenized and carefully processed to achieve the required strength and consistency for forming roll supports. Recycled plastics are much easier to reprocess. PET, as with a great variety of plastic materials, is initially segregated by the consumer at disposal, after which it is typically kept clean and uniform during the entire recycling process, thereby retaining its material properties.

Figure 3:
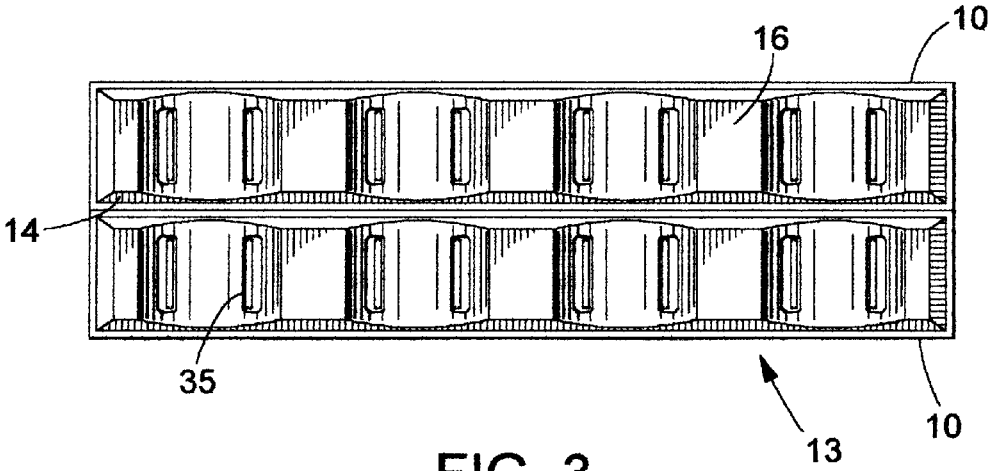
FIG. 3 is a top view of a pair of roll supports, according to an embodiment of this invention.

The use of high strength, resinous plastic polymers are a significant improvement over the fibrous, papier-machine materials taught by U.S. Pat. No. 5,080,314 to Moyer. Like Moyer '314 the roll supports 10 of the present invention are preferably manufactured in a pair 13, as shown in FIG. 3. However, the paired roll supports of the present invention can easily stack onto another pair with only a slight increase in height. The most preferred thickness of the roll support of the present invention is only approximately 40 Mils, which is 0.04 inches. This small thickness is a significant advantage over the stacked pairs of Moyer '314, in that the inherent thickness of the papier-mache material prevents adequate nesting. This inherent thickness of the wood fiber, papier-machine material prohibits a close nested stacking of unused roll supports.

With the improved nesting achieved by the theremoforming of thin walls for the roll supports 10, hundreds of the plastic roll supports of the present invention can stack in the same height as only tens of Moyer '314 or Knitter '453 supports. The nesting compactness of the present invention provides a substantial and significant savings in shipping and storage space, as compared to wood fiber materials. The precious space saved in the storage of the nested and still unused roll supports can be allotted to other storage needs. Alternatively, the saved storage or shipping space can be used to store or transport additional roll supports and allow the purchase of higher quantities to realize bulk rate cost savings and substantially reduce freight costs.

As also shown in FIGS. 3 and 5, each pair 13 of roll supports 10 preferably include a foldable edge 14 that provides the connected pair with the ability to fold together and form a center support 15, as shown in FIG. 5. Additionally, the foldable edge can be utilized as a separation edge, for detaching the pair from each other and forming two separate roll supports.

Figure 2:
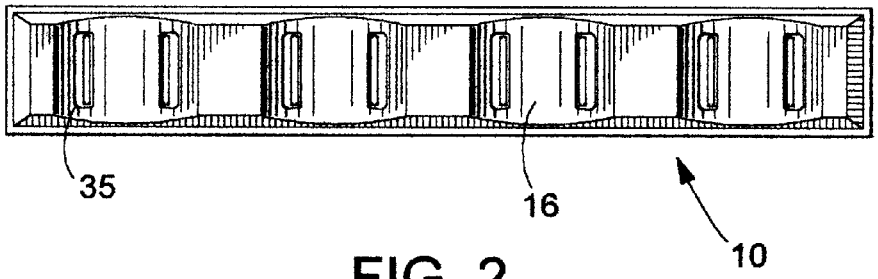
FIG. 2 is a top view of a roll support, according to an embodiment of this invention.

The roll supports 10, as individually shown in FIGS. 2 and 4 each include a support body 16 formed from the resinous plastic material. As detailed in FIG. 4, the elongated body also includes a first surface 17 and a second surface 18. When the roll support is used to support the roll stock from beneath the roll, similar to the orientation shown in FIG. 4, the first surface is the upper surface of the roll support and the second surface is the lower surface.

The roll support 10 is configured to receive a plurality of the roll stock, as shown in FIGS. 1 and 6. Each of the roll stock has a cylindrical radius 19 that preferably is consistent for each roll supported in an individual storage array 20, as detailed in FIG. 6. The first surface 17 of each roll support includes a plurality of curved cradles 22 along the length of the support body, as shown in FIG. 5. Each curved cradle is a semi-cylindrical indentation sized to receive the cylindrical roll stock, as detailed in FIG. 6. The curved cradles also each have a radius of curvature 24, as shown in FIG. 4. The most preferable radius of curvature of the cradle is approximately the cylindrical radius of the roll stock, but can be as large as approximately twice cylindrical radius of the roll stock. The preferable radius of curvature of the cradle is therefore approximately equal to or slightly larger than the cylindrical radius of the roll stock.

The roll stock 12 can be any one of a variety of materials typically wrapped around a spool 26 or core. This rolled material is conventionally placed in the cylindrical roll for storage, transport and eventual use. The rolled material can be any web material, plastic or film, such as polyethylene or cellophane. As an example, the packaging manufacturing and printing industry employs rolls of plastic film, typically polyethylene, to fabricate bags that receive a printed design or label.

It is also considered possible to blend the plastic, polymeric material that forms the roll support 10 of the present invention from other, non-resinous materials, like wood fiber or carbon fiber. These blended, composite materials would be formulated to maintain the thin-walled, thermoformed, advantages as described for the present invention.

The roll support 10 of the present invention are preferably used in multiples to receive and support a plurality of the roll stock 12. As shown in FIGS. 1 and 6, the roll stock is received by the multiple roll supports to form an array 28, which is an arrangement of stacked tiers of the roll stock, preferably built upon a pallet 29 or a similar portable platform. First, a bottom support row 30 of the roll supports are placed onto the pallet. Three or four of the roll supports are employed to support the weight of the roll stock received onto the pallet and prevent the roll stock from shifting on the pallet. The pallet can be any type of pallet, made of wood, plastic or a composite material. Although the pallets are preferred, the roll supports could also be placed upon a floor or shelf system as an alternative.

In further forming the array 28 shown in FIGS. 1 and 6, approximately four roll stock 12 elements are placed upon the bottom support row 30. This first tier of roll stock from a bottom stock tier 33 of the roll stock and roll support array. This bottom stock tier can now receive a multiple of the center supports 15, which are pairs 13 of folded roll supports. Again, an individual center support is shown in FIG.

5. The center support efficiently transfers and supports the weight of the supported roll stock with the aid of indentations, or support lands 35, within the curved cradles 20 of the roll supports. The support lands abut to the corresponding indentations that form the lands of the paired roll support. These abutted indentations aid in the transfer of weight through the paired roll supports. The support lands are located along the curved cradles 22 and preferably placed in pairs on both opposing sides of the curvature. The support lands terminate at the second surface 18 of the roll support.

Firstly to form the array 28, the roll support 10 is used in a single support at the bottom of the individual storage array, and typically resting on a pallet 29, as shown in FIGS. 1 and 6. The support lands 35 aid in supporting the weight of an object, typically the roll stock, that rests on the same supporting surface, such as the pallet, as the roll support.

The center support 15, placed on the bottom stock tier 33, each receive upper stock tiers 37, as also shown in FIGS. 1 and 6. The array 28 continues upward, tier by tier, to a top tier 38 of roll stock 12. The top tier of row stock then receives approximately four roll supports with their first surface facing downward, as shown in FIGS. 1 and 6, and the curved cradles 22 placed upon the top tier to finish the array. Additionally, a strapping 40 can be wrapped around each set of roll supports, as shown in FIG. 1 and 6, to bind the array together.

Each cylinder of roll stock 12 has a significant weight. For a plastic film roll stock than can be supported with the present invention, this weight is typically between 50 and 150 pounds. The roll supports 10 are employed in the array 28 to support a plurality of the roll stock, as again illustrated in FIG. 5. Each of the roll supports individually, or folded as the paired central supports 15, must handle the weight of the supported portion of each roll of the cylindrical roll stock received within the curved cradles 20, upwardly through the array. Since each elongated body 14 preferably includes four to five curved cradles 22 and each roll is supported by as few as two or three roll supports, each curved cradle must support more than 50 pounds. Additionally, since each roll support must handle the weight of the tiers or rows of roll stock transferred to it from above, the supporting requirements on the bottom most curved cradles are much higher than 50 pounds. A bottom most tier, to accommodate shifting weights may be required to support weights in excess of 4,000 pounds. This is especially true if there are multiple pallets of multi-tiered cylindrical roll stock, each stacked upon another, as found in typical storage warehouses.

The roll support 10 has a supported weight and the roll of cylindrical stock 12 has a stock weight. The portion of the stock weight of a single roll of the cylindrical stock supported by an individual curved cradle 22 is a supported weight. This weight ratio is preferably greater than 1 to 50, and can be higher than 1 to 1,000. By this extraordinary weight to supported weight ratio, the weight of the roll support is clearly remarkably less than the weight supported by the roll support. This weight relationship of the roll support's weight to the weight of the roll stock supported by the roll support clearly differentiates the roll support of the present invention and plastic supports for light weight articles. Heavier articles will crush the conventionally configured, plastic resin trays and protective containers, which are typically manufactured to hold lightweight and fragile items like fluorescent light bulbs.

In compliance with the statues, the invention has been described in language more or less specific as to structural features and process steps. While this invention is susceptible to embodiment in different forms, the specification illustrates preferred embodiments of the invention with the understanding that the present disclosure is to be considered an exemplification of the principles of the invention, and the disclosure is not intended to limit the invention to the particular embodiments described. Those with ordinary skill in the art will appreciate that other embodiments and variations of the invention are possible, which employ the same inventive concepts as described above. Therefore, the invention is not to be limited except by the following claims, as appropriately interpreted in accordance with the doctrine of equivalents.

What is claimed is:

1. A support for receiving and supporting stacked tiers of cylindrical roll stock, the support comprising:

a support body formed from a plastic material, the support body having a first surface and a second surface, the first surface including a plurality of curved cradles, each curved cradle sized for receiving a roll of cylindrical stock, and the support body for supporting a tiered array of the cylindrical stock, the support body having a height and a material thickness, the support body stackably nestable onto another support body to form a nested stack, the nested stack having a nested height, and the nested stack having a nested height substantially equal to the height of the support body plus the material thickness of the nest support body.

2. The support of claim 1, wherein the plastic material is also a resinous, polymeric material.

3. The support of claim 1, wherein the plastic, polymeric material is a polyethylene terephthalate.

4. The support of claim 1, wherein the support body is thermoformed.

5. The support of claim 1, wherein a multiple of the support bodies combine to support a multiple of the rolls of cylindrical stock, the rolls of cylindrical stock supported by the support bodies to form a bottom tier of supported roll stock, and the bottom tier of the supported roll stock additionally supports a minimum of two additional tiers of the cylindrical roll stock, and each of the two additional tiers of the cylindrical is also supported by additional support bodies.

6. The support of claim 1, wherein the roll of cylindrical stock has a weight and each support body substantially supports the weight of each roll of cylindrical stock received within the curved cradles.

7. The support of claim 1, wherein the plastic material is a recycled plastic, material.

8. The support of claim 1, wherein the support body has a weight and the roll of cylindrical stock has a total weight and a supported weight, the supported weight being a portion of the total weight of a single roll of the cylindrical stock as supported by an individual elongated body, and the weight of the elongated body is less than the supported weight of the roll of cylindrical stock.

9. The support of claim 1, wherein:

the support body has a height and a material thickness, the material thickness of the support body approximately 0.04 inches, and each one of the rolls of cylindrical stock supported by the support body weighs in excess of 50 pounds.

10. A support for receiving and supporting stacked tiers of cylindrical roll stock, the support comprising:

a support body formed from a plastic material, the support body having a first surface and a second surface and a height, the first surface including a plurality of curved cradles, each curved cradle sized for receiving a roll of cylindrical stock, and the support body for supporting a tiered array of the cylindrical stock, each of the rolls of the cylindrical stock weighing in excess of 50 pounds, the support body having a height and a material thickness, the material thickness of the support body approximately 0.04 inches, and the support body stackably nestable onto another support body to form a nested stack, the nested stack having a nested height, and the nested stack having a nested height substantially equal to the height of the support body plus the material thickness of the support body.

11. The support of claim 10, wherein the support body has a weight and the roll of cylindrical stock has a total weight and a supported weight, the supported weight being a portion of the total weight of a single roll of the cylindrical stock as supported by an individual elongated body, and the weight of the elongated body is less than the supported weight of the roll of cylindrical stock.

12. The support of claim 10, wherein the plastic material is also a resinous, polymeric material.

13. The support of claim 10, wherein the plastic, polymeric material is a polyethylene terephthalate.

14. The support of claim 10, wherein the support body is thermoformed.

15. The support of claim 10, wherein a multiple of the support bodies combine to support a multiple of the rolls of cylindrical stock, the rolls of cylindrical stock supported by the support bodies to form a bottom tier of supported roll stock, and the bottom tier of the supported roll stock additionally supports a minimum of two additional tiers of the cylindrical roll stock, and each of the two additional tiers of the cylindrical is also supported by additional support bodies.

16. The support of claim 10, wherein the roll of cylindrical stock has a weight and each support body substantially supports the weight of each roll of cylindrical stock received within the curved cradles.

17. The support of claim 10, wherein the plastic material is a recycled plastic, material.

* * * * *